US010593493B2

(12) United States Patent
Takasuka et al.

(10) Patent No.: US 10,593,493 B2
(45) Date of Patent: Mar. 17, 2020

(54) ELECTROMAGNETICALLY MOVING DEVICE

(71) Applicant: Mitsubishi Electric Corporation, Chiyoda-ku (JP)

(72) Inventors: Tomoko Takasuka, Chiyoda-ku (JP); Mitsugi Mori, Chiyoda-ku (JP); Mitsuru Tsukima, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 50 days.

(21) Appl. No.: 16/077,529

(22) PCT Filed: Mar. 3, 2017

(86) PCT No.: PCT/JP2017/008543
§ 371 (c)(1),
(2) Date: Aug. 13, 2018

(87) PCT Pub. No.: WO2017/154784
PCT Pub. Date: Sep. 14, 2017

(65) Prior Publication Data

US 2019/0074148 A1 Mar. 7, 2019

(30) Foreign Application Priority Data

Mar. 7, 2016 (JP) ..... 2016-042995

(51) Int. Cl.
*H01H 9/00* (2006.01)
*H01H 33/38* (2006.01)
(Continued)

(52) U.S. Cl.
CPC ..... *H01H 33/38* (2013.01); *H01F 3/10* (2013.01); *H01F 7/064* (2013.01); *H01F 7/1844* (2013.01);
(Continued)

(58) Field of Classification Search
CPC ..... H01F 3/10; H01F 7/064; H01H 33/38
USPC ..... 335/205
See application file for complete search history.

(56) References Cited

U.S. PATENT DOCUMENTS 4,608,620 A 8/1986 Hines
6,816,048 B2 * 11/2004 Morita ..... H01F 7/1615 218/154
(Continued)

FOREIGN PATENT DOCUMENTS

JP 62-119828 A 6/1987
JP 1-144583 U 10/1989
(Continued)

OTHER PUBLICATIONS

International Search Report dated May 9, 2017 in PCT/JP2017/008543 filed Mar. 3, 2017.
(Continued)

*Primary Examiner* — Alexander Talpalatski
(74) *Attorney, Agent, or Firm* — Oblon, McClelland, Maier & Neustadt, L.L.P.

(57) ABSTRACT

In an electromagnetically moving device 100, a magnetic-flux variation measuring unit 3 is placed at a position which is outside a closed magnetic path established when a movable core 6 and a stationary core 5 are being attached to each other due to permanent magnets 7, and at which a leakage magnetic-flux variation due to movement of the movable core 6 can be measured, so that a behavior of a movable part in a switch, etc. is estimated such that an inflection point time is calculated from the measurement of time-series data of the magnetic-flux variation.

20 Claims, 11 Drawing Sheets

(51) Int. Cl.

| | |
|---|---|
| ***H01H 33/666*** | (2006.01) |
| ***H01F 7/18*** | (2006.01) |
| ***H01F 3/10*** | (2006.01) |
| ***H01F 7/06*** | (2006.01) |
| ***H01H 1/00*** | (2006.01) |
| *H01F 7/16* | (2006.01) |
| *H01H 36/00* | (2006.01) |

(52) U.S. Cl.
CPC ..... *H01H 1/0015* (2013.01); *H01H 33/6662* (2013.01); *H01F 7/1615* (2013.01); *H01F 7/1623* (2013.01); *H01F 2003/103* (2013.01); *H01F 2007/185* (2013.01); *H01F 2007/1855* (2013.01); *H01H 33/666* (2013.01); *H01H 2036/0086* (2013.01)

(56) References Cited

U.S. PATENT DOCUMENTS

| | | | | |
|---|---|---|---|---|
| 9,293,243 | B2 * | 3/2016 | Kim | H01F 7/1615 |
| 2007/0222427 | A1 | 9/2007 | Takeuchi et al. | |
| 2009/0138212 | A1 | 5/2009 | Maruyama | |
| 2012/0169441 | A1 * | 7/2012 | Kim | H01F 7/1615 335/179 |
| 2015/0371748 | A1 * | 12/2015 | Kim | H01F 7/18 361/190 |

FOREIGN PATENT DOCUMENTS

| | | | |
|---|---|---|---|
| JP | 2010-101468 | A | 5/2010 |
| JP | 2011-253860 | A | 12/2011 |
| JP | 2012-113964 | A | 6/2012 |
| JP | 2014-207065 | A | 10/2014 |
| WO | WO 2005/111641 | A1 | 11/2005 |
| WO | WO 2007/108063 | A1 | 9/2007 |

OTHER PUBLICATIONS

Notifications of Reasons for Refusal dated Jan. 9, 2018 in corresponding Japanese Patent Application No. 2017-549528, 13 pages (with English machine translation).

* cited by examiner

ELECTROMAGNETICALLY MOVING DEVICE

TECHNICAL FIELD

The present application relates to an electromagnetically moving device used for a switching operation of a switch/breaker.

BACKGROUND ART

Conventional Electromagnetically moving devices are used for switches or breakers each provided with a stationary contact and a movable contact, by which, when their turn-on coil is energized and excited, the movable contact is turned on and then the contact is retained by a magnetic force of their permanent magnet. Meanwhile, the opening operation is carried out in such a manner that their opening coil is energized and excited in a direction counteracting the attraction force of the permanent magnet, so that the contact is separated off due to a repulsive force of an energy-storing spring. Since the electromagnetically moving device is so structured as described above, when the electro-magnetically moving device fails, there is a likelihood that the breaker or its circuit is damaged, thus causing a power failure or the like. Accordingly, there is a demand for techniques to constantly recognize the operation status of the electromagnetically moving device. Main factors that may cause changes in behavior of the electromagnetically moving device, include: spring load; contact abrasion; movable-part friction; voltage drop in a power source for energizing a drive coil (capacity drop in a capacitor); and the like. Monitoring these changes makes it possible to prevent a failure of the breaker or the switch from occurring, and further, if a spot at which an abnormality is exhibited can be determined, an effect of saving effort in maintenance is promising.

It is easily conceivable to install a stroke sensor as a means for recognizing the status of the electromagnetically moving device; however, this can not avoid enlargement and cost increase of the device. Thus, with respect to a method without using a stroke sensor, there is proposed an electromagnet-operation monitoring device as disclosed in, for example, Patent Document 1. In the electromagnet-operation monitoring device disclosed in Patent Document 1, a turn-on coil to be energized when a movable core is turned on and a releasing coil to be energized when the core is opened, are wound around the outside of the movable core. At the time the turning-on operation is performed in such an electromagnet operation device, a current is caused to flow in the turn-on coil, so that the coil is excited and an induction voltage is generated in the non-energized releasing coil. According to the electromagnet-operation monitoring device, each value of the current flowing in the turn-on coil and each value of the induction voltage generated in the releasing coil are measured, and in their respective temporal waveforms, inflection points (the timing of the operation command, the timing of the start of the movement of the movable core, and the timing of the completion of the movement of the movable core) are detected, so that a necessitated time for the movement of the movable core is calculated. In the case of opening operation, each value of current when a current is caused to flow in the releasing coil and each value of the induction voltage generated in the turn-on coil are measured.

CITATION LIST

Patent Document

Patent Document 1: Japanese Patent Application Laid-open No. 2011-253860 (Paragraph 0022; FIG. 1)

SUMMARY OF THE INVENTION

Problems to be Solved by the Invention

In the electromagnetically moving devices, at the time of performing an opening/closing operation of the switch/breaker, a timing exists at which the movable contact and the stationary contact are released from each other and thus the speed of the movable core changes on its way, and said timing varies according to wear, etc. of the contacts. According to a conventional status monitoring means as shown in Patent Document 1 for the electromagnetically moving device, the characteristic point at the releasing of the contacts and at which the speed of the movable core changes on its way, is less likely to be revealed, so that there is a problem that the wear, etc. of the contacts can not be estimated accurately.

Further, according to a conventional status monitoring means as shown in Patent Document 1 for the electromagnetically moving device, when it is adapted to an electromagnetically moving device of an open magnetic-path type in which, with respect to the moving direction of the movable core, the positions of the turn-on coil and the opening coil are placed concentratedly on the side of the surface toward which the movable core is attracted, the induction voltage in the non-excited coil depends largely on the current for excitation, and the ratio of its amount of change due to the movement of the movable coil becomes small. Thus, the characteristic points, in particular, at the start of the movement of the movable core and at the completion of the movement thereof, are less likely to be revealed, so that there is a problem that it is difficult to estimate its behavior.

This application has been made to solve the problems as described above, and an object thereof is to provide an electromagnetically moving device which is highly versatile, and can properly and accurately estimate the behavior of a movable part in a switch/breaker, without using a stroke sensor.

Means for Solving the Problems

An electromagnetically moving device of the application is characterized by comprising:

a movable core; a stationary core with which the movable core is provided in a releasably attachable manner thereto and a permanent magnet is provided so as to attract the movable core; a drive coil which, when a driving current is applied thereto, causes the movable core to move; and a magnetic-flux variation measuring unit: which is provided outside a closed magnetic path that is established when the movable core and the stationary core are being attached to each other and along which a magnetic flux generated by the permanent magnet passes; and which measures a leakage magnetic-flux variation that emerges at the time the movable core moves due to a magnetic force generated when the driving current is applied to the drive coil.

Effect of the Invention

According to the application, due to the measurement of the magnetic-flux variation, it is possible properly estimate the behavior of the movable part in a switch/breaker.

MODES FOR CARRYING OUT THE INVENTION

Embodiment 1

Figure 1:
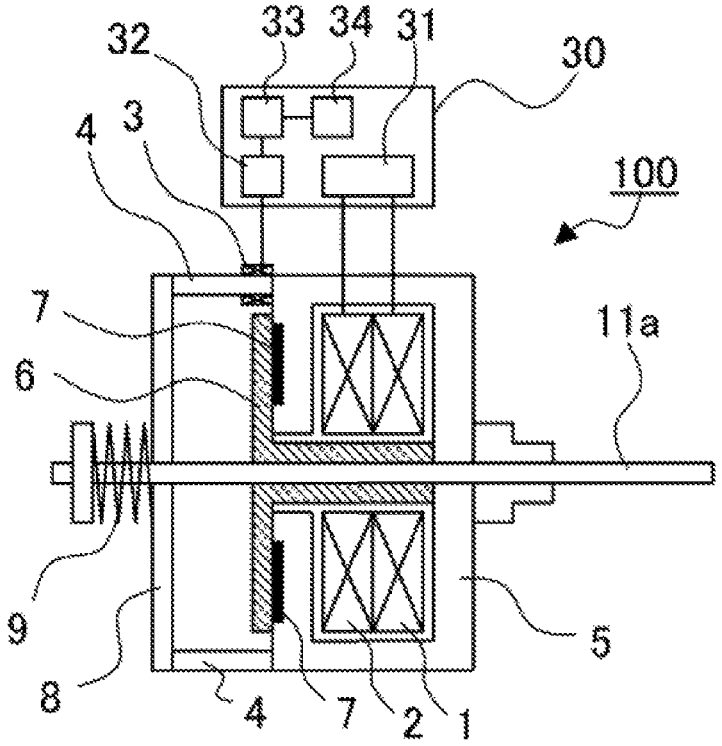
FIG. 1 is a cross-sectional view for explaining a configuration of an electromagnetically moving device according to Embodiment 1 of the application.
Figure 2:
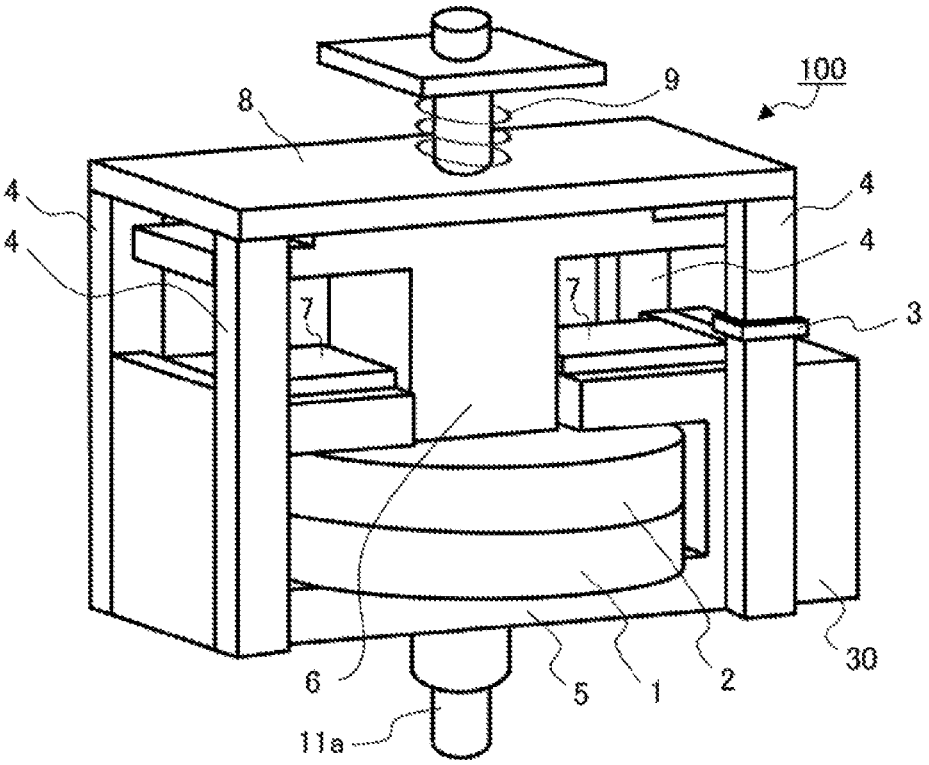
FIG. 2 is an external perspective view for explaining the configuration of the electromagnetically moving device according to Embodiment 1 of the application.

FIG. 1 is a cross-sectional view showing a configuration of an electromagnetically moving device 100 according to Embodiment 1 of the application, and FIG. 2 is a perspective view thereof. As shown in FIG. 1 and FIG. 2, the electromagnetically moving device 100 is configured with an opening coil 1, a turn-on coil 2, a magnetic-flux variation measuring unit 3, support columns 4, a stationary core 5, a movable core 6, permanent magnets 7, a stopper plate 8, an opening spring 9, a driving shaft 11*a* and a measurement control section 30.

In the electromagnetically moving device 100, the stationary core 5 is placed so as to surround the opening coil 1 and the turn-on coil 2 as drive coils. The movable core 6 is provided in a releasably attachable manner to the stationary core 5, and the permanent magnets 7 are each placed on a surface where the stationary core and the movable core 6 are attached to each other. Further, the movable core 6 is configured with the driving shaft 11*a* penetrating therethrough and so that it is movable in the bore of the opening coil 1 and the turn-on coil 2 as drive coils. The stopper plate 8 is supported by the support columns 4 fixed to the stationary core 5, to thereby restrict the moving range of the movable core 6. The opening spring 9 is placed on the stopper plate 8 at its side opposite to its surface facing the movable core 6, and is so arranged that such a force is applied thereby that is directed opposite to an attraction force between the movable core 6 and the stationary core 5 due to a magnetic force of the permanent magnets 7.

Figure 3:
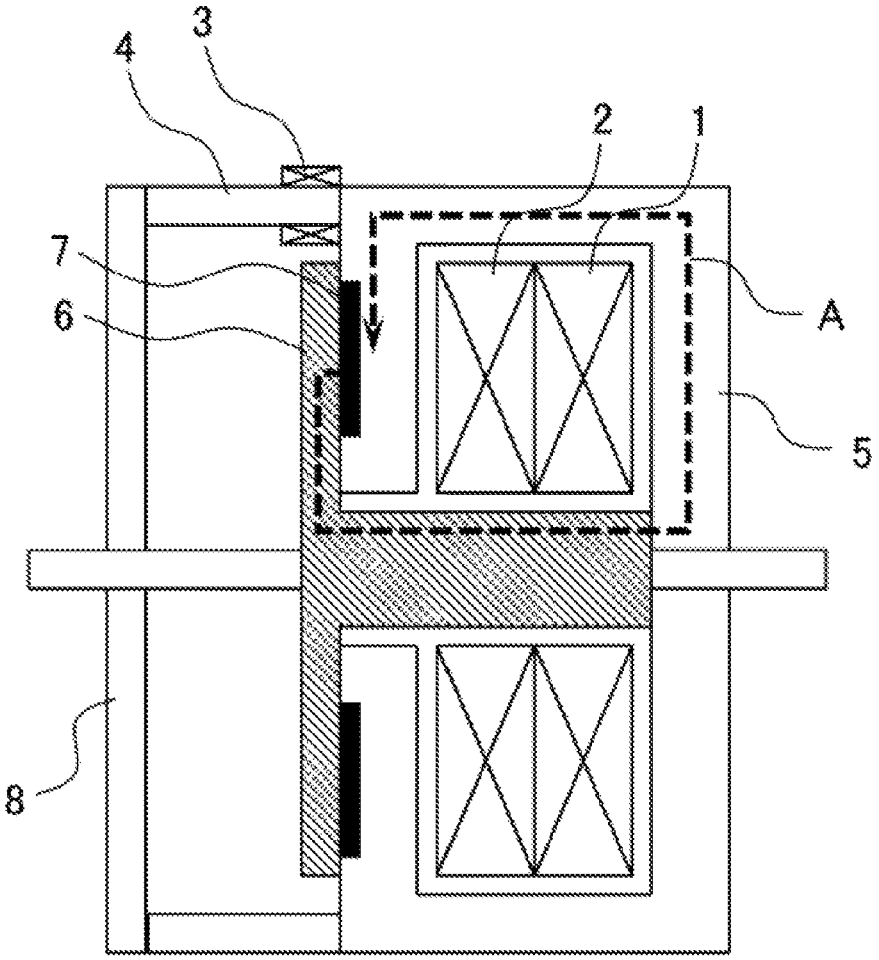
FIG. 3 is a cross-sectional view showing a magnetic-flux flow caused by a permanent magnet, when a movable core and a stationary core are being attached to each other, in the electromagnetically moving device according to Embodiment 1 of the application.

The magnetic-flux variation measuring unit 3 is placed at a position which is outside a closed magnetic path that is established when the movable core 6 and the stationary core 5 are being attached to each other by the permanent magnets 7, and at which a leakage magnetic-flux variation due to movement of the movable core 6 can be measured. FIG. 3 shows a magnetic-flux flow A caused by the permanent magnet 7 when the movable core 6 and the stationary core 5 are being attached to each other, in the electromagnetically moving device 100 according to Embodiment 1 of the application. As shown in FIG. 3, in Embodiment 1 of the application, the magnetic-flux variation measuring unit 3 is placed on one of the four supports columns that is outside the closed magnetic path established by the magnetic-flux flow A caused by the permanent magnet 7.

With respect to the placement position of the magnetic-flux variation measuring unit 3, in Embodiment 1, the unit is placed on the support column 4 because there is no need to separately provide a support member and thus its fixing is easy; however, though depending on the structure of the electromagnetically moving device, the fixing may be done to a component other than the above, or may be done using a separate support member. Further, the unit may be placed on a part of the stationary core 5 or the movable core 6, if the position of that part is out of the closed magnetic path and at which the leakage magnetic flux can be measured. Note that, in Embodiment 1 of the application, the path of the leakage magnetic field goes through the stationary core 5, the movable core 6, the stopper plate 8 and the support column 4 (there may be cases without going through the stopper plate); however, though depending on the placement position of the magnetic-flux variation measuring unit 3, this is not limitative, and there may be cases where, when the path goes through the stationary core 5 only, the unit is placed on the stationary core 5.

As the magnetic-flux variation measuring unit 3, a relatively-inexpensive coil is used, and an induction voltage is measured such that the coil is wound around the support column 4. The magnetic-flux variation measuring unit 3 may be that which uses a Hall element or an MR (Magneto Resistive) element. Meanwhile, in order to enhance the sensitivity of the magnetic-flux variation measuring unit 3, the support column 4 and the stopper plate 8 are each made up of a magnetic member.

The measurement control section 30 controls the operation of the electromagnetically moving device 100, and performs processing of time-series data of the magnetic-flux variation measured by the magnetic-flux variation measuring unit 3, and the like. The measurement control section 30 is configured with a driving current control unit 31, a behavior estimation unit 32, a status determination unit 33 and a notification unit 34.

The behavior estimation unit 32 processes the time-series data of the magnetic-flux variation measured by the magnetic-flux variation measuring unit 3 to thereby estimate the operation status of the movable core 6. Here, the operation status of the movable core 6 includes the start of its movement and the completion of its movement that are positional information thereof, and in addition, its speed, a midstream change in its speed and the like. Furthermore, the behavior estimation unit 32 estimates, from the operation status of the movable core 6, the status of a movable contact and a stationary contact in a vacuum valve that constitutes a switching part of a vacuum circuit breaker, namely, a wear amount of the contacts.

Further, the status determination unit 33 determines whether or not an abnormality occurs in the electromagnetically moving device 100, the vacuum valve or the like, on the basis of the operation status of the movable core 6 and the wear amount of the movable contact and the stationary contact in the vacuum valve, estimated by the behavior estimation unit 32. The notification unit 34 makes notification of the estimation result by the behavior estimation unit 32 and the determination result by the status determination unit 33, to the outside through an indication lamp, a buzzer, telecommunication and/or the like. The driving current control unit 31, the behavior estimation unit 32, the status determination unit 33 and the notification unit 34 are herein constituted by an electronic component, such as a microcomputer or the like.

Figure 4A:
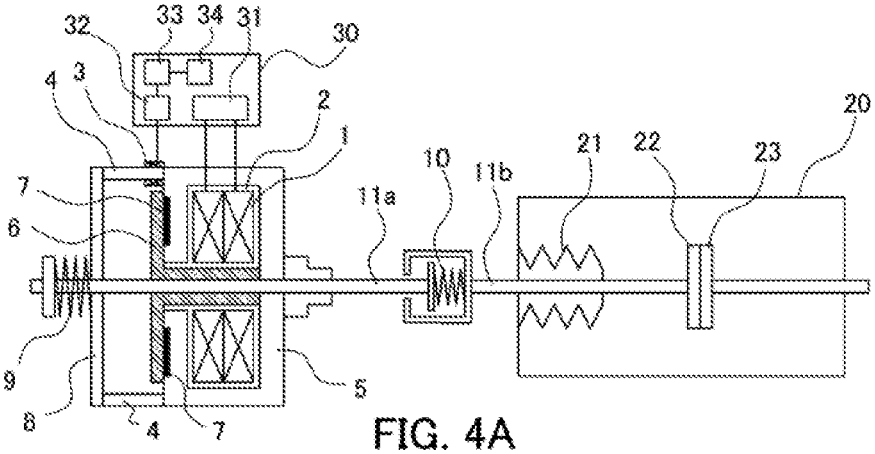
FIG. 4A, FIG. 4B and FIG. 4C are cross-sectional views each for explaining an operation of the electromagnetically moving device according to Embodiment 1 of the application.
Figure 4B:
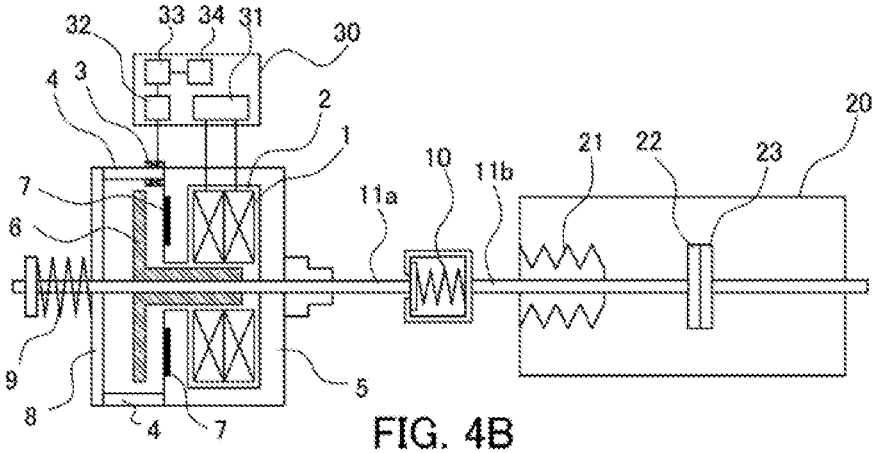
Figure 4C:
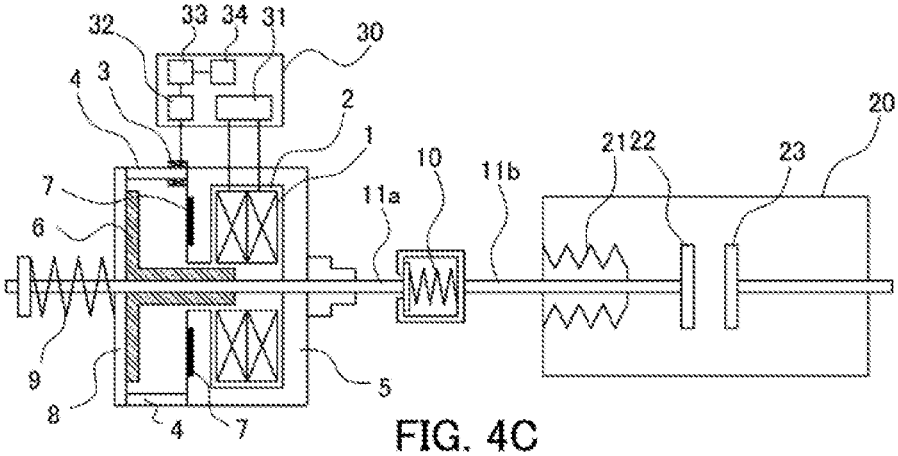

Next, operations of the electromagnetically moving device 100 according to Embodiment 1 of the application will be described using figures. FIG. 4A, FIG. 4B and FIG. 4C are cross-sectional schematic diagrams each showing an operation of the electromagnetically moving device 100 according to Embodiment 1 of the application.

Figure 5:
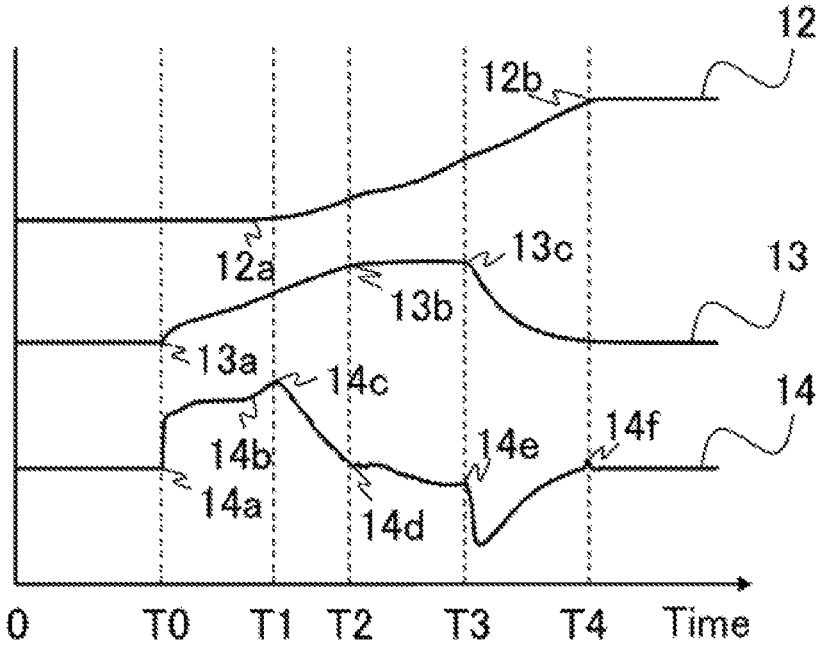
FIG. 5 is a graph showing a temporal waveform of magnetic-flux variation caused by the movable core at the time of opening operation by the electromagnetically moving device according to Embodiment 1 of the application.
Figure 6A:
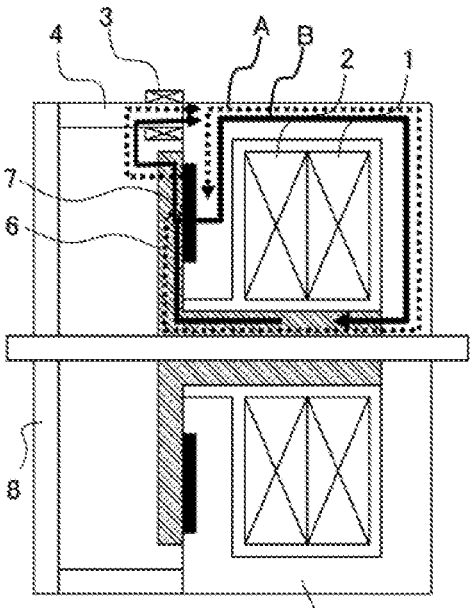
FIG. 6A, FIG. 6B and FIG. 6C are cross-sectional views each showing a magnetic-flux flow at the time of opening operation by the electromagnetically moving device according to Embodiment 1 of the application.
Figure 6B:
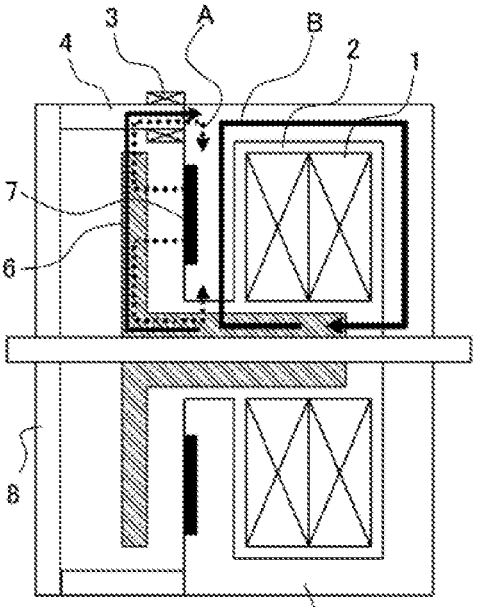
Figure 6C:
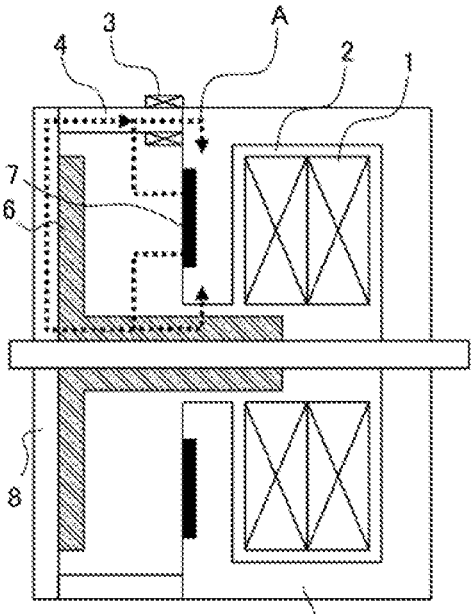

FIG. 4A is a diagram showing a closed state of a vacuum valve 20 provided with the electromagnetically moving device 100. FIG. 4B is a diagram showing a state in which the contacts transit from being closed to being open, due to the movement of the movable core 6. FIG. 4C is a diagram showing an open state of the vacuum valve 20. FIG. 5 is a graph showing respective temporal waveforms 12, 13 and 14 of a position of the movable core 6, a current flowing in the opening coil 1 and an output of the magnetic-flux variation measuring unit 3, at the time of opening operation of the vacuum valve 20 provided with the electromagnetically moving device 100 according to Embodiment 1 of the application. FIG. 6A, FIG. 6B and FIG. 6C are cross-sectional views each showing a magnetic-flux flow under opening operation of the vacuum valve 20 provided with the electromagnetically moving device 100 according to Embodiment 1 of the application. FIG. 6A is a diagram showing the flow after the application of a releasing current but just before the movement. FIG. 6B is a diagram showing the flow during the movement. FIG. 6C is a diagram showing the flow at the time of completion of the movement. Note that, in FIG. 5, the output waveform 14 at the magnetic-flux variation measuring unit 3 is actually measured data, whereas the position waveform 12 of the movable core 6 and the driving-current waveform 13 are waveforms for just describing the operation and are not data measured in this Embodiment.

Initially, as shown in FIG. 4A, the vacuum valve 20 provided with the electromagnetically moving device 100 is in the closed state. Because the attraction force due to the magnetic force of the permanent magnets 7 exceeds the opening force by the opening spring 9 and a contact pressure spring 10, the movable core 6 and the stationary core 5 are attached to each other, so that a movable contact is closed in such a manner that it is pressed to a stationary contact 23 through the force of the contact pressure spring 10. On this occasion, the magnetic-flux flow is as shown in FIG. 3, and only the magnetic flux-A by the permanent magnet 7 is provided because no energization is applied to the opening coil 1 and the turn-on coil 2. The permanent magnet causes no magnetic-flow variation, so that, as shown in FIG. 5, the output waveform 14 of the magnetic-flux variation measuring unit 3 stays at zero in the range from time 0 to time T0.

Then, in order to perform the opening operation, energization to the opening coil 1 is started using the driving current control unit 31. When a current is caused to flow in the opening coil 1, a magnetic force is generated in a direction counteracting the magnetic force of the permanent magnets 7. Just after the start of the energization, because of the time constant of the opening coil 1, there is a delay time before the current reaches a value required for opening. That time emerges in the range from time T0 to time T1 shown in FIG. 5, in which, as shown by the magnetic-flux flow in FIG. 6A, a leakage magnetic flux B generated by the driving current flows through the magnetic-flux variation measuring unit 3, so that, at the magnetic-flux variation measuring unit 3, an output emerges according to the amount of that variation. In the output waveform 14, its value increases abruptly (inflection point 14*a*) at the same time as the start of the energization (inflection point 13*a*) and, in the range from time T0 to time T1, slightly increases or reaches a constant value, due to increase of the driving current.

When the driving current increases and the attraction force due to the magnetic force of the permanent magnets 7 falls below the opening force by the opening spring 9 and a contact pressure spring 10, the movable core 6 starts to move (inflection point 12*a*). With the start of the movement, the gap between the stationary core 5 and the movable core 6 becomes wider, so that the leakage magnetic flux temporarily increases significantly and the output of the magnetic-flux variation measuring unit 3 increases accordingly (inflection point 14*b*). However, immediately thereafter, the magnetic flux flows as shown in FIG. 6B, so that the magnetic flux B caused by the driving current forms a different magnetic path without going through the permanent magnet 7. Thus, although the amount of leakage magnetic flux increases because the gap between the stationary core 5 and the movable core 6 becomes wider, the output (amount of a magnetic-flux variation) of the magnetic-flux variation measuring unit 3 starts to decrease (inflection point 14*c*).

When the movable core 6 moves and reaches the state as shown in FIG. 4B, the force by the contact pressure spring 10 does not work, so that the movable contact 22 pressed by the contact pressure spring 10 to the stationary contact 23 starts to move, and thus the stationary contact 23 and the movable contact 22 are released from each other. On this occasion, the movable contact 22 and a driving shaft 11*b* are added to the moving objects that were only the movable core 6 and the driving shaft 11*a*, so that their mass and friction increase. This reduces the speed of the movable objects, so that an inflection point appears in the output of the magnetic-flux variation measuring unit (inflection point 14*d*).

Thereafter, when the application of the driving current to the opening coil 1 is stopped (inflection point 13*c*), the output of the magnetic-flux variation measuring unit 3 swings significantly to the minus side (inflection point 14*e*)

and then diminishes as the driving current decreases. On this occasion, the driving current is going to continue flowing in the freewheel diode even though its outputting is suspended by the driving current control unit 31, so that, for a while, it continues flowing while decreasing.

Lastly, as shown in FIG. 4C, the movable core 6 moves to the position of the stopper plate 8 (inflection point 12*b*), so that the movement of the movable core 6 stops. At this time, because the driving current to the opening coil 1 has almost disappeared, the magnetic flux flows as in FIG. 6C, and because the movement has stopped, there is no magnetic-flux variation due to the permanent magnets 7, so that the output of the magnetic-flux variation measuring unit 3 becomes zero (inflection point 14*f*).

Although the inflection point 14*f* appears because the output of the magnetic-flux variation measuring unit 3 becomes zero suddenly, the amount of variation in the output of the magnetic-flux variation measuring unit 3 is small because the amount of the magnetic flux itself decreases due to no application of the driving current and separation of the movable core 6 from the permanent magnets 7. Here, if the support column 4 and the stopper plate 8 are provided as magnetic members, it is possible to increase the amount of magnetic flux at the time the movable core 6 stops, so that the output of the magnetic-flux variation measuring unit 3 can increase temporarily just before the stoppage of the movable core 6 and accordingly, the inflection point 14*f* will appear sharply.

As thus described, according to the output waveform 14 of the magnetic-flux variation measuring unit 3, the inflection points 14*a*, 14*c*, 14*d*, 14*e* and 14*f* appear, respectively, at time T0 at which the energization to the opening coil 1 is started, time T1 at which the movable core 6 starts to move, time T2 (Opening Time) at which the movable contact 22 and the stationary contact 23 are released from each other, time T3 at which the energization to the opening coil 1 is stopped, and time T4 at which the movement of the movable core 6 stops. Using the behavior estimation unit 32, the respective inflection-point times T0, T1, T2, T3, T4 are calculated and compared respectively with normal-condition times (reference values) T0*s*, T1*s*, T2*s*, T3*s*, T4*s* measured at the delivery inspection, etc. and prestored in the behavior estimation unit 32, so that an opening speed that is the speed of the movable contact 22, a contact wear amount of the movable contact 22 and the stationary contact 23, and the like, are estimated. For example, if focusing on the contact wear amount of the movable contact 22 and the stationary contact 23, it is estimated utilizing the fact that a wear of the contacts reduces the pressing amount of the contact pressure spring 10, thus shortening the distance taken by the movable core 6 from the start of its movement until when the movable contact 22 and the stationary contact 23 are released from each other, and further reducing the moving speed of the movable core 6, so that (T2−T1) and (T4−T2) will both change.

The status of the movable contact 22 and the stationary contact 23 opposite to the movable contact 22, that is estimated by the behavior estimation unit 32, namely, the data of the opening speed, the contact wear amount and the like, is transmitted to the status determination unit 33. The status determination unit 33 compares them with their reference values (threshold values) prestored in the status determination unit 33, and determines that they are normal if they are in range, and that they are abnormal if they are out of range.

The data of the opening speed, the contact wear amount and the like, as the behavior estimated result estimated by the behavior estimation unit 32, and the data indicative of normality/abnormality, as the status determination result determined by the status determination unit 33, are transmitted to the notification unit 34. The notification unit 34 performs: alarming through indication by an LED, etc. or through a buzzer, etc., so as to make notification to the outside; data transmission through a contact output or telecommunication, so as to use an external device; or something like that.

Figure 7:
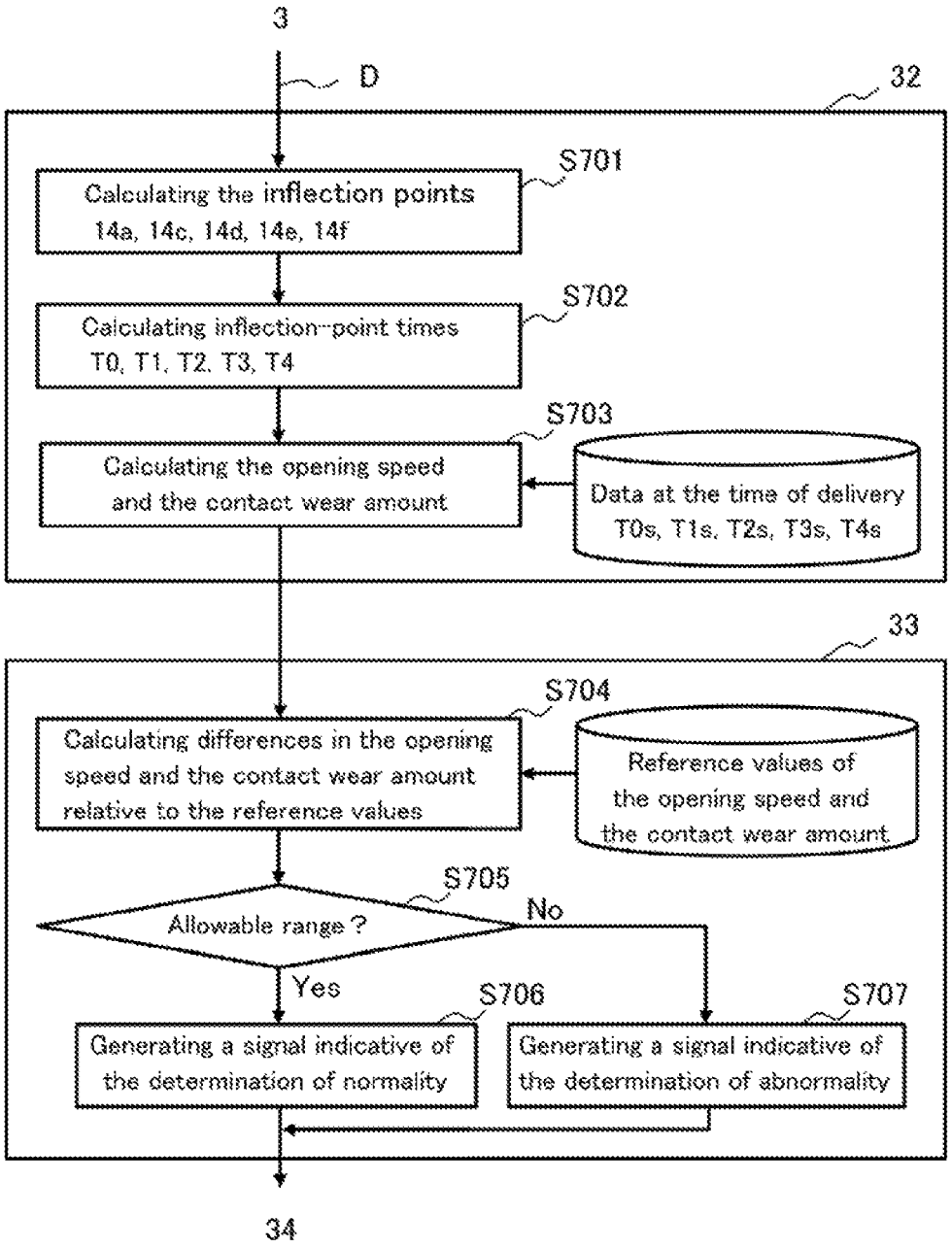
FIG. 7 is a flowchart showing data and a process flow in a measurement control section of the electro-magnetically moving device according to Embodiment 1 of the application.

Next, data and a process flow in the measurement control section 30 of the electromagnetically moving device 100 according to Embodiment 1 of the application will be described using the figure. FIG. 7 is a flowchart showing the data and the process flow in the measurement control section 30 of the electromagnetically moving device 100 according to Embodiment 1 of the application.

First of all, as shown in FIG. 7, the behavior estimation unit 32 calculates the inflection points 14*a*, 14*c*, 14*d*, 14*e*, 14*f* from the time-series data D of the magnetic-flux variation provided from the magnetic-flux variation measuring unit 3 (Step S701), to thereby calculate inflection-point times T0, T1, T2, T3, T4 corresponding to the respective inflection points (Step S702).

Subsequently, the behavior estimation unit 32 compares the calculated inflection-point times T0, T1, T2, T3, T4 respectively with normal-condition times (reference values) T0*s*, T1*s*, T2*s*, T3*s*, T4*s* that are data at the time of delivery, to thereby calculate the opening speed and the contact wear amount (Step S703).

Then, the status determination unit 33 performs calculation of differences in the opening speed and the contact wear amount calculated by the behavior estimation unit 32, relative to the reference values (threshold values) for the opening speed and the contact wear amount (Step S704), to thereby determine whether or not they are in allowable range (Step S705).

The status determination unit 33, when they are determined to be in allowable range (Yes in Step S705), generates a signal indicative of the determination of normality (Step S706) and, when they are determined to be out of allowable range (No in Step S705), generates a signal indicative of the determination of abnormality (Step S707), and then transmits that signal to the notification unit 34. The notification unit 34 makes notification of normality/abnormality to the outside, and then terminates.

As described above, in the electro-magnetically moving device 100 according to Embodiment 1 of the application, the magnetic-flux variation measuring unit 3 is placed at a position which is outside the closed magnetic path established when the movable core 6 and the stationary core 5 are being attached to each other due to the permanent magnets 7, and at which a leakage magnetic-flux variation due to movement of the movable core 6 can be measured. Thus, at the measurement of the time-series data of the magnetic-flux variation, it is possible to cause inflection points due to the influence of the movement of the movable core to appear, so that, when the inflection-point times are calculated and compared with the normal-condition values, it is possible to estimate the wear amount, etc. of a movable part in the switch/breaker, in particular, that of the contacts, to thereby properly estimate the behavior of the movable part. Further, the magnetic-flux variation measuring unit 3 is mounted on the support column 4, there is no need to separately provide a support member and thus its fixing is easy. Furthermore, since the support column 4 and the stopper plate 8 are provided as magnetic members, it is possible to make clearer the inflection points in the time-series data of the magnetic-flux variation (in particular, at the time at which the movement of the movable core stops). Further, since the status determination unit 33 and the notification unit 34 are provided, it is possible to determine an abnormality and to make notification thereof.

Embodiment 2

In Embodiment 1, the description has been made about the case where the magnetic-flux variation measuring unit 3 is placed on one of the four support columns 4, whereas in Embodiment 2, description will be made about a case where it is placed on each of plural support columns.

Figure 8:
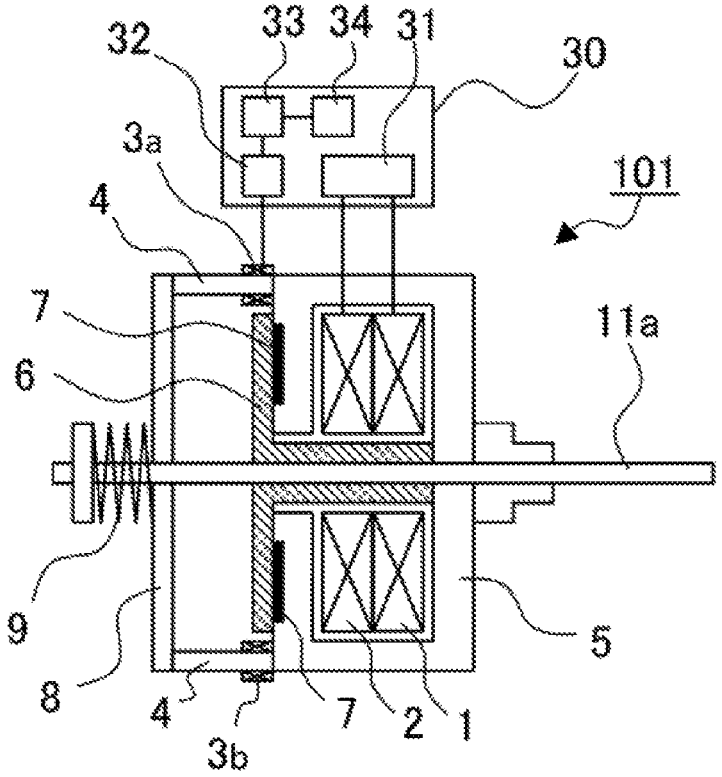
FIG. 8 is a cross-sectional view for explaining a configuration of an electromagnetically moving device according to Embodiment 2 of the application.
Figure 9:
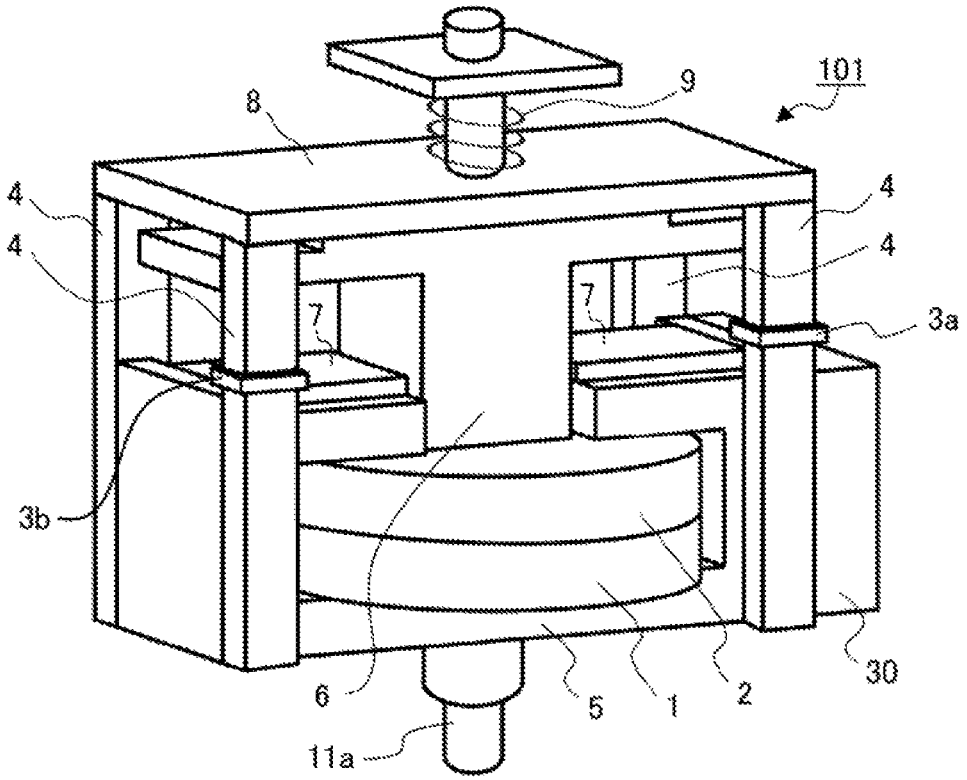
FIG. 9 is an external perspective view for explaining the configuration of the electromagnetically moving device according to Embodiment 2 of the application.

FIG. 8 is a cross-sectional view showing a configuration of an electromagnetically moving device 101 according to Embodiment 2 of the application, and FIG. 9 is a perspective view thereof. As shown in FIG. 8 and FIG. 9, in the electromagnetically moving device 101, two magnetic-flux variation measuring units 3*a*, 3*b* are placed on two of the four support columns each existing outside the closed magnetic path formed by the magnetic-flux flow caused by the permanent magnet 7. The other configuration of the electromagnetically moving device 101 is the same as that of the electromagnetically moving device 100 of Embodiment 1, so that the same reference numerals are given to the equivalent parts and description thereof is omitted here.

The time-series data of each magnetic-flux variation measuring units 3*a*, 3*b* in this case shows the tendency similar to that in FIG. 5; however, because of a rightward/leftward inclination or displacement of the movable core 6 from its center axis, a variation occurs in horizontal gap between the stationary core 5 and the movable core 6, so that a difference in position of the reflection point in the time-series data emerges between the magnetic-flux variation measuring units 3*a*, 3*b*. The respective time-series data of the magnetic-flux variation measuring units 3*a*, 3*b* are transmitted to the behavior estimation unit 32, and the behavior estimation unit 32 determines the respective inflection points from the time-series data of the magnetic-flux variation measuring units 3*a*, 3*b*, to thereby calculate times T0*a*, T1*a*, T2*a*, T3*a*, T4*a* and times T0*b*, T1*b*, T2*b*, T3*b*, T4*b*, at the respective inflection points. Here, the behavior estimation unit 32 calculates times T0, T1, T2, T3, T4, through making correction on the respective data obtained from the magnetic-flux variation measuring units 3*a*, 3*b* so that these data can be regarded as data obtained from a single magnetic-flux variation measuring unit.

Examples of the method for that correction include: a method of averaging the respective inflection-point times T0, T1, T2, T3, T4 obtained from the magnetic-flux variation measuring units 3*a*, 3*b*, using the data of the magnetic-flux variation measuring units 3*a*, 3*b*, and then defining the averaged ones as new times T0, T1, T2, T3, T4; and the like. Increasing the number of the magnetic-flux variation measuring units 3 makes more accurate the correction of a data error caused by an inclination or displacement of the movable core 6.

Figure 10:
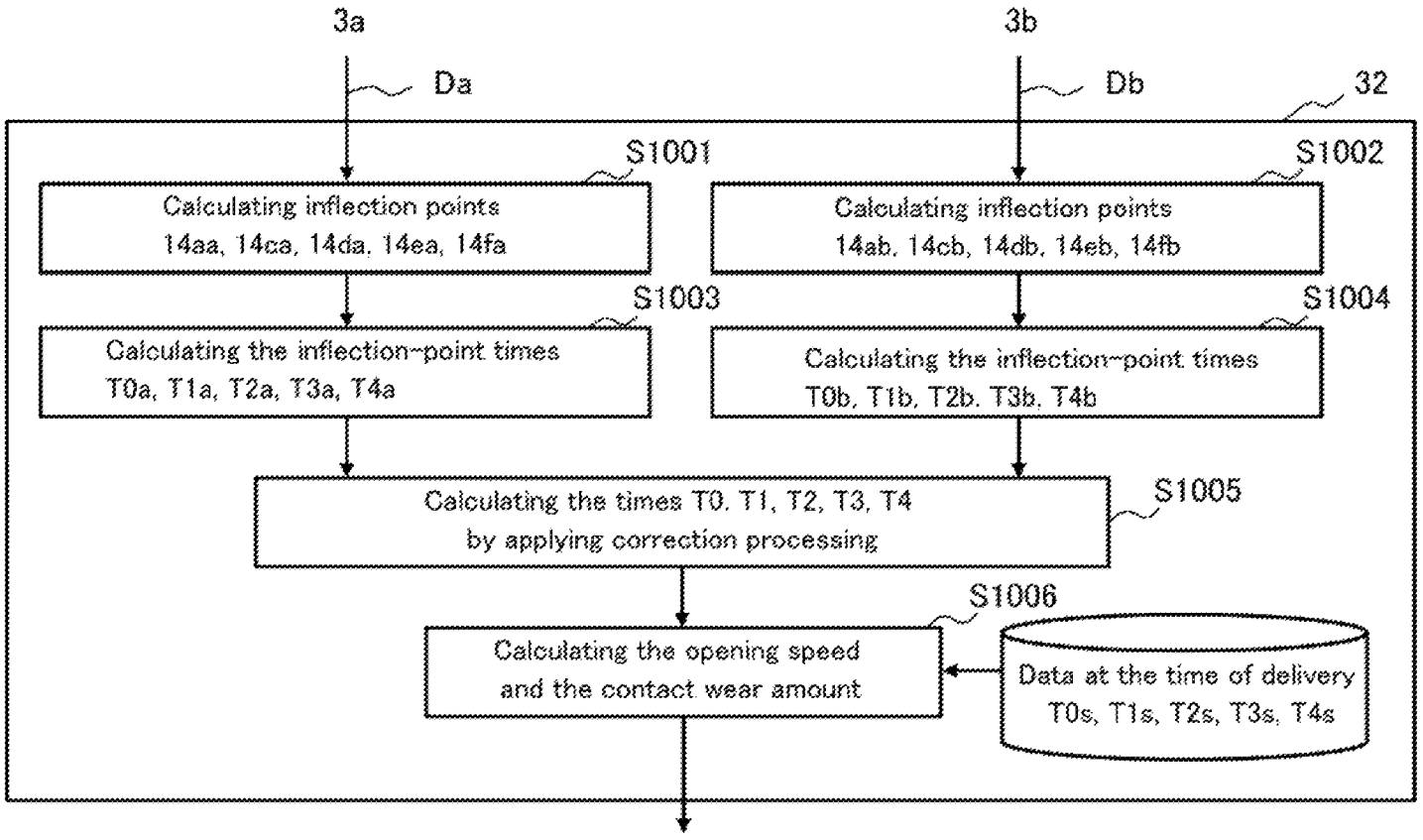
FIG. 10 is a flowchart showing data and a process flow in a measurement control section of the electro-magnetically moving device according to Embodiment 2 of the application.

Next, data and a process flow in the measurement control section 30 of the electromagnetically moving device 101 according to Embodiment 2 of the application will be described using the figure. FIG. 10 is a flowchart showing the data and the process flow in the measurement control section 30 of the electro-magnetically moving device 101 according to Embodiment 2 of the application.

First of all, as shown in FIG. 10, the behavior estimation unit 32 calculates inflection points 14*aa*, 14*ca*, 14*da*, 14*ea*, 14*fa* and inflection points 14*ab*, 14*cb*, 14*db*, 14*eb*, 14*fb* from respective time-series data Da, Db of the magnetic-flux variation provided from the magnetic-flux variation measuring units 3*a*, 3*b* (Step S1001 and Step S1002), to thereby calculate the inflection-point times T0*a*, T1*a*, T2*a*, T3*a*, T4*a* and the times T0*b*, T1*b*, T2*b*, T3*b*, T4*b* corresponding to the respective inflection points (Step S1003 and Step S1004).

Subsequently, the behavior estimation unit 32 calculates the times T0, T1, T2, T3, T4 by applying correction processing to the calculated respective inflection-point times T0*a*, T1*a*, T2*a*, T3*a*, T4*a* and the times T0*b*, T1*b*, T2*b*, T3*b*, T4*b* to thereby convert them into a single set of data (Step S1005).

Then, the behavior estimation unit 32 compares the calculated inflection-point times T0, T1, T2, T3, T4 respectively with normal-condition times (reference values) T0*s*, T1*s*, T2*s*, T3*s*, T4*s* that are data at the time of delivery, to thereby calculate the opening speed and the contact wear amount (Step S1006). The behavior estimation unit 32 outputs the calculated opening speed and contact wear amount to the status determination unit 33. The data and the process flow in the status determination unit 33 are the same as those in Embodiment 1, so that description thereof is omitted here.

As described above, in the electro-magnetically moving device 101 according to Embodiment 2 of the application, the multiple magnetic-flux variation measuring unit 3*a*, 3*b* are each placed at a position which is outside the closed magnetic path established when the movable core 6 and the stationary core 5 are being attached to each other due to the permanent magnets 7, and at which a leakage magnetic-flux variation due to movement of the movable core 6 can be measured. This makes it possible to correct a data error caused by an inclination or displacement of the movable core. Thus, it is possible to estimate more accurately the wear amount, etc. of a movable part in the switch/breaker, in particular, that of the contacts, so that the estimation accuracy on the behavior of the movable part can be further enhanced.

Embodiment 3

In Embodiment 1 and Embodiment 2, the description has been made about the case where the behavior estimation unit 32 refers to the normal values (reference values) measured at the delivery inspection, etc., whereas in Embodiment 3, description will be made about a case where the behavior estimation unit 32 does not use such data measured at the delivery inspection, etc.

In the case where, for some reason, an electronic circuit included in the measurement control section 30 is changed, or an element in the magnetic-flux variation measuring unit 3 or a movable-part component in the switch/breaker is replaced, there is a likelihood that the device is recognized as another individual than that at the time of delivery, so that the previous data may affect the status determination result. Accordingly, resetting of the reference values is required. In the following, operations of the behavior estimation unit 32 when only one magnetic-flux variation measuring unit 3 is provided will be described, citing as an example a case where the breaker is inspected while its main circuit is de-energized and then an electronic circuit included in the measurement control section 30 is replaced.

With respect to the breaker separated from the main circuit, an operator transmits a signal representing starting of learning of the reference values in the behavior estimation unit 32, by way of the measurement control section 30, to the behavior estimation unit 32. Upon receiving the signal transmitted from the measurement control section 30, the behavior estimation unit 32 deletes reference-value data stored therein.

After the behavior estimation unit 32 is placed in a reference-value-data deleted state, the switching operation of the breaker is performed n times using an external power source or a power source included in the measurement control section 30. On this occasion, the behavior estimation unit 32 calculates inflection points 14*an*, 14*cn*, 14*dn*, 14*en*, 14*fn* (n=1, 2, . . . ) using the time-series data of the magnetic-flux variation measured by the magnetic-flux variation measuring unit 3, to thereby calculates respective inflection-point times T0*n*, T1*n*, T2*n*, T3*n*, T4*n* (n=1, 2, . . . ). Using the inflection-point times T0*n*, T1*n*, T2*n*, T3*n*, T4*n* calculated at every switching operation, representative values for these inflection-point times are calculated, for example, by summing and averaging of them, or the like. The thus-provided new representative values are stored as the reference-value data of T0*s*, T1*s*, T2*s*, T3*s*, T4*s*.

After the switching operation is performed arbitrary number of times and the reference values in the behavior estimation unit 32 are updated, the operator transmits a signal representing completion of learning of the reference values in the behavior estimation unit 32, by way of the measurement control section 30, to the behavior estimation unit 32. Upon receiving the signal transmitted from the measurement control section 30, the behavior estimation unit 32 terminates updating of the reference-value data stored therein. Then, the operator connects the breaker to the main circuit and then starts the energization. Note that the number of times of switching operation to be executed for setting the reference values is determined in an arbitrary manner depending on the accuracy demanded by the employed environment or the like.

Figure 11:
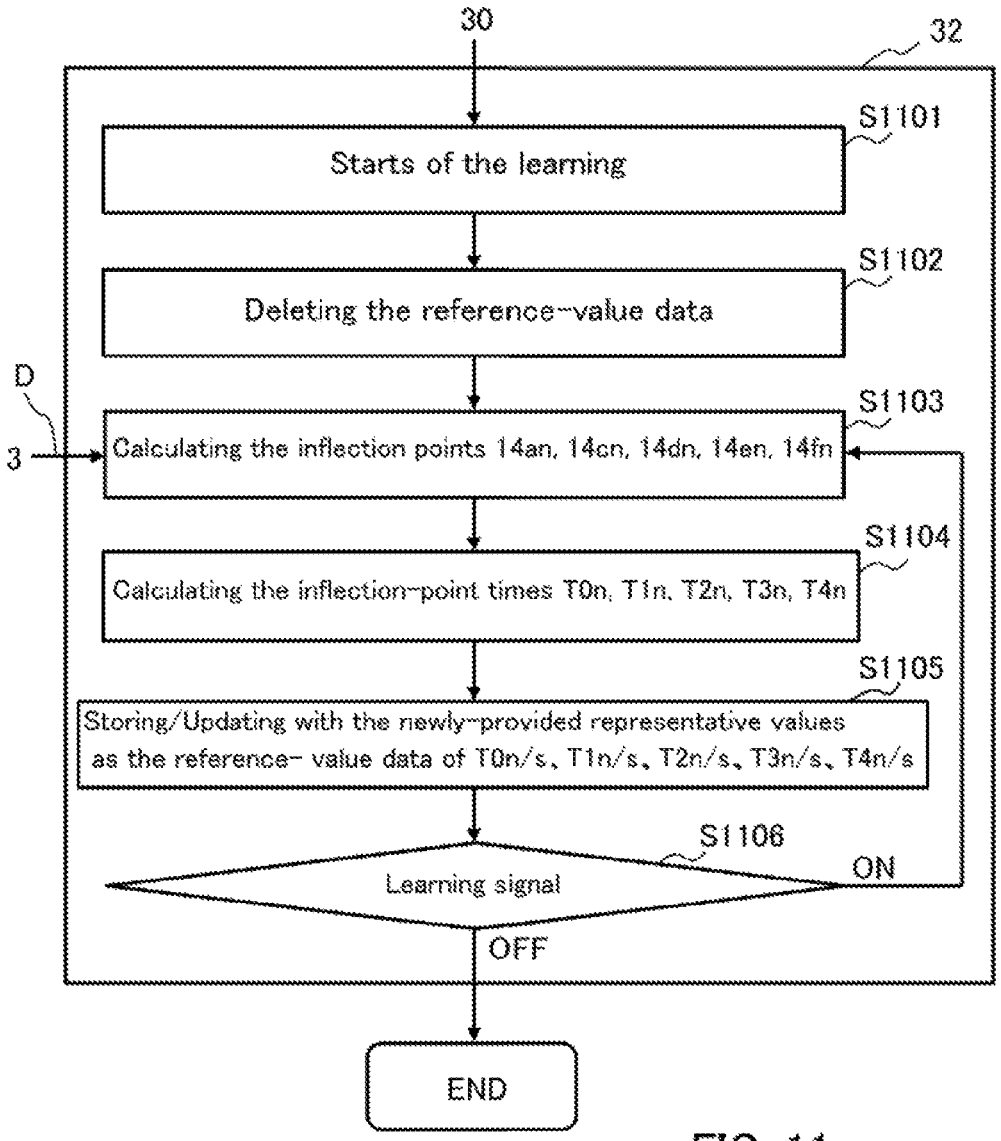
FIG. 11 is a flowchart showing data and a process flow in a measurement control section of the electro-magnetically moving device according to Embodiment 3 of the application.

Next, data and a process flow in the measurement control section 30 of the electromagnetically moving device 102 according to Embodiment 3 of the application will be described using the figure. FIG. 11 is a flowchart showing the data and the process flow in the measurement control section 30 of the electro-magnetically moving device 102 according to Embodiment 3 of the application.

First of all, as shown in FIG. 11, upon receiving the signal for starting the learning from the measurement control section 30, the behavior estimation unit 32 starts the learning (Step S1101) and deletes the reference-value data stored therein (Step S1102).

Subsequently, the switching operation of the breaker is caused by the measurement control section 30 by using an external power source or a power source included in the measurement control section 30, so that the behavior estimation unit 32 calculates the inflection points 14*an*, 14*cn*, 14*dn*, 14*en*, 14*fn* from the time-series data D of the magnetic-flux variation provided from the magnetic-flux variation measuring unit 3 (Step S1103), to thereby calculate the inflection-point times T0*n*, T1*n*, T2*n*, T3*n*, T4*n* corresponding to the respective inflection points (Step S1104), and store them therein (Step S1105).

Then, according to the learning signal of the measurement control section 30 (ON in Step S1106), the behavior estimation unit 32 causes the switching operation to be performed n times (from Step S1103 to Step S1106). After the operation is performed n times, using the inflection-point times T0*n*, T1*n*, T2*n*, T3*n*, T4*n* calculated at every n-th switching operation, the behavior estimation unit 32 calculates the representative values for the inflection-point times, and performs updating with the newly-provided representative values as the reference-value data of T0*s*, T1*s*, T2*s*, T3*s*, T4*s* (Step S1105 after n times).

Lastly, after updating the reference-value data, the behavior estimation unit 32 terminates the learning for updating the reference-value data, according to a learning completion signal of the measurement control section 30 (OFF in Step S1106).

As described above, in the electro-magnetically moving device 102 according to Embodiment 3 of the application, the reference-value data is updated by the behavior estimation unit 32. Thus, even when an electronic circuit included in the measurement control section 30 is changed, or an element in the magnetic-flux variation measuring unit 3 or a movable-part component in the switch/breaker is replaced, it is possible to estimate the wear amount, etc. of a movable part in the switch/breaker, in particular, that of the contacts, so that the estimation accuracy on the behavior of the movable part can be further enhanced.

It should be noted that unlimited combination of the respective embodiments and an appropriate modification/omission in the embodiments may be made in the present application without departing from the scope of the application.

DESCRIPTION OF REFERENCE NUMERALS and SIGNS

1: opening coil, 3: magnetic-flux variation measuring unit, 5: stationary core, 6: movable core, 7: permanent magnet, 100, 101, 102: electromagnetically moving device.

The invention claimed is:

1. An electromagnetically moving device, comprising:

a movable core;

a stationary core with which the movable core is provided in a releasably attachable manner thereto and a permanent magnet is provided so as to attract the movable core, said stationary core being provided at a position where it forms, when the movable core is not attached thereto, a magnetic path without going through the permanent magnet;

a stopper plate which is provided at a position where the movable core reaches its moving end after being separated from the stationary core, and is made up of a magnetic member;

a support column for supporting the stopper plate, which is fixed to the stationary core, and is made up of a magnetic member;

a drive coil which, when a driving current is applied thereto, causes the movable core to move; and a magnetic-flux variation measurer:

which is provided on the support column placed outside a closed magnetic path that passes attached surfaces of the movable core and the stationary core when the movable core and the stationary core are being attached to each other; and which measures a leakage magnetic-flux variation that emerges in the support column at the time the movable core moves due to a magnetic force generated when the driving current is applied to the drive coil.

2. The electromagnetically moving device according to claim 1, further comprising a behavior estimator which estimates an operation status of the movable core on the basis of: time-series data of the magnetic-flux variation measured by the magnetic-flux variation measuring device; and reference-value data.

3. The electromagnetically moving device according to claim 2, wherein the behavior estimator has prestored the reference-value data.

4. The electromagnetically moving device according to claim 3, wherein the behavior estimator deletes the prestored reference-value data to thereby update the reference-value data.

5. The electromagnetically moving device according to claim 2, further comprising a status determinator which determines whether or not an abnormality occurs in a switching apparatus connected to the movable core, on the basis of an output of the behavior estimator.

6. The electromagnetically moving device according to claim 3, further comprising a status determinator which determines whether or not an abnormality occurs in a switching apparatus connected to the movable core, on the basis of an output of the behavior estimator.

7. The electromagnetically moving device according to claim 4, further comprising a status determinator which determines whether or not an abnormality occurs in a switching apparatus connected to the movable core, on the basis of an output of the behavior estimator.

8. The electromagnetically moving device according to claim 5, wherein the behavior estimator estimates a status of a movable contact and a stationary contact opposite to the movable contact, in the switching apparatus.

9. The electromagnetically moving device according to claim 6, wherein the behavior estimator estimates a status of a movable contact and a stationary contact opposite to the movable contact, in the switching apparatus.

10. The electromagnetically moving device according to claim 7, wherein the behavior estimator estimates a status of a movable contact and a stationary contact opposite to the movable contact, in the switching apparatus.

11. The electromagnetically moving device according to claim 5, further comprising a notificator which makes notification of a behavior estimation result by the behavior estimator or a status determination result by the status determinator, to the outside.

12. The electromagnetically moving device according to claim 6, further comprising a notificator which makes notification of a behavior estimation result by the behavior estimator or a status determination result by the status determinator, to the outside.

13. The electromagnetically moving device according to claim 7, further comprising a notificator which makes notification of a behavior estimation result by the behavior estimator or a status determination result by the status determinator, to the outside.

14. The electromagnetically moving device according to claim 8, further comprising a notificator which makes notification of a behavior estimation result by the behavior estimator or a status determination result by the status determinator, to the outside.

15. The electromagnetically moving device according to claim 9, further comprising a notificator which makes notification of a behavior estimation result by the behavior estimator or a status determination result by the status determinator, to the outside.

16. The electromagnetically moving device according to claim 10, further comprising a notificator which makes notification of a behavior estimation result by the behavior estimator or a status determination result by the status determinator, to the outside.

17. The electromagnetically moving device according to claim 1, wherein multiple magnetic-flux variation measurers, each being said magnetic-flux variation measurer, are provided.

18. The electromagnetically moving device according to claim 2, wherein multiple magnetic-flux variation measurers, each being said magnetic-flux variation measurer, are provided.

19. The electromagnetically moving device according to claim 17, wherein an operation status of the movable core is estimated on the basis of time-series data outputted from the multiple magnetic-flux variation measurers.

20. The electromagnetically moving device according to claim 18, wherein an operation status of the movable core is estimated on the basis of time-series data outputted from the multiple magnetic-flux variation measurers.

* * * * *